US005540070A

United States Patent [19]

Adelmeyer

[11] Patent Number: 5,540,070

[45] Date of Patent: Jul. 30, 1996

[54] AUXILIARY LOCK WITH REVERSIBLE ADAPTER

[75] Inventor: Gerard G. Adelmeyer, Anaheim, Calif.

[73] Assignee: Emhart Inc., Newark, Del.

[21] Appl. No.: 350,577

[22] Filed: Dec. 7, 1994

[51] Int. Cl.[6] ..... E05B 9/08

[52] U.S. Cl. ..... 70/370; 70/451; 70/462; 292/244; 292/337

[58] Field of Search ..... 70/461, 462, 370, 70/451, 466, 381, 372–374, 448, 449; 292/244, 337

[56] References Cited

U.S. PATENT DOCUMENTS 4,272,974 6/1981 Hennessy ..... 70/370 X 4,338,804 7/1982 Solovieff ..... 292/337 X 5,335,525 8/1994 Solovieff ..... 70/451 X

FOREIGN PATENT DOCUMENTS 2249580 5/1992 United Kingdom ..... 70/466

*Primary Examiner*—Lloyd A. Gall

*Attorney, Agent, or Firm*—Spencer T. Smith

[57] ABSTRACT

A deadbolt or auxiliary lock is disclosed which can be mounted in a small (1½") or large (2⅛") lock set hole. A reversible cast adapter is provided which has a plate portion, small and large diameter annular lips on one side and a small diameter lip on the other side with a torque limiting feature projecting axially from each small diameter lip.

6 Claims, 3 Drawing Sheets

AUXILIARY LOCK WITH REVERSIBLE ADAPTER

The present invention relates to auxiliary locks (often referred to as deadbolts) and more particularly to an auxiliary lock which can be used in either a 1½" or a 2⅛" lock set hole and which has an integral torque limiting feature.

Deadbolt locks have a lock on the exterior of the door and it is desirable to protect the lock from an attempted illegal entry. This is done by providing a cylinder guard enclosing the locking cylinder. The guard may be rotatable to isolate the mounting screws. To increase the effectiveness of the guard shielding, either integral with the guard or a separate structure which cooperates with the guard, can be provided which projects into the lock set hole to protect the portion of the cylinder lock which projects into the lock set hole. Additionally, the shield may include a torque limiting structure which cooperates with the latch assembly to prevent rotation of the cylinder housing which could break the mounting screws. See, for example, U.S. Pat. Nos. 4,338,804 and 5,335,525. No design has been able to provide a torque limiting structure which can be used in both a 1½" and 2⅛" lock set holes.

It is accordingly an object of the present invention to provide an auxiliary lock which can be mounted in either a 1½" or a 2⅛" lock set hole and which when mounted in either lock set hole will have a torque limiting feature.

Other objects and advantages of the present invention will become apparent from the following portion of this specification and from the accompanying drawings which illustrate in accordance with the mandate of the patent statutes a presently preferred embodiment incorporating the principles of the invention.

Referring to the drawings.

Figures 1, 5:
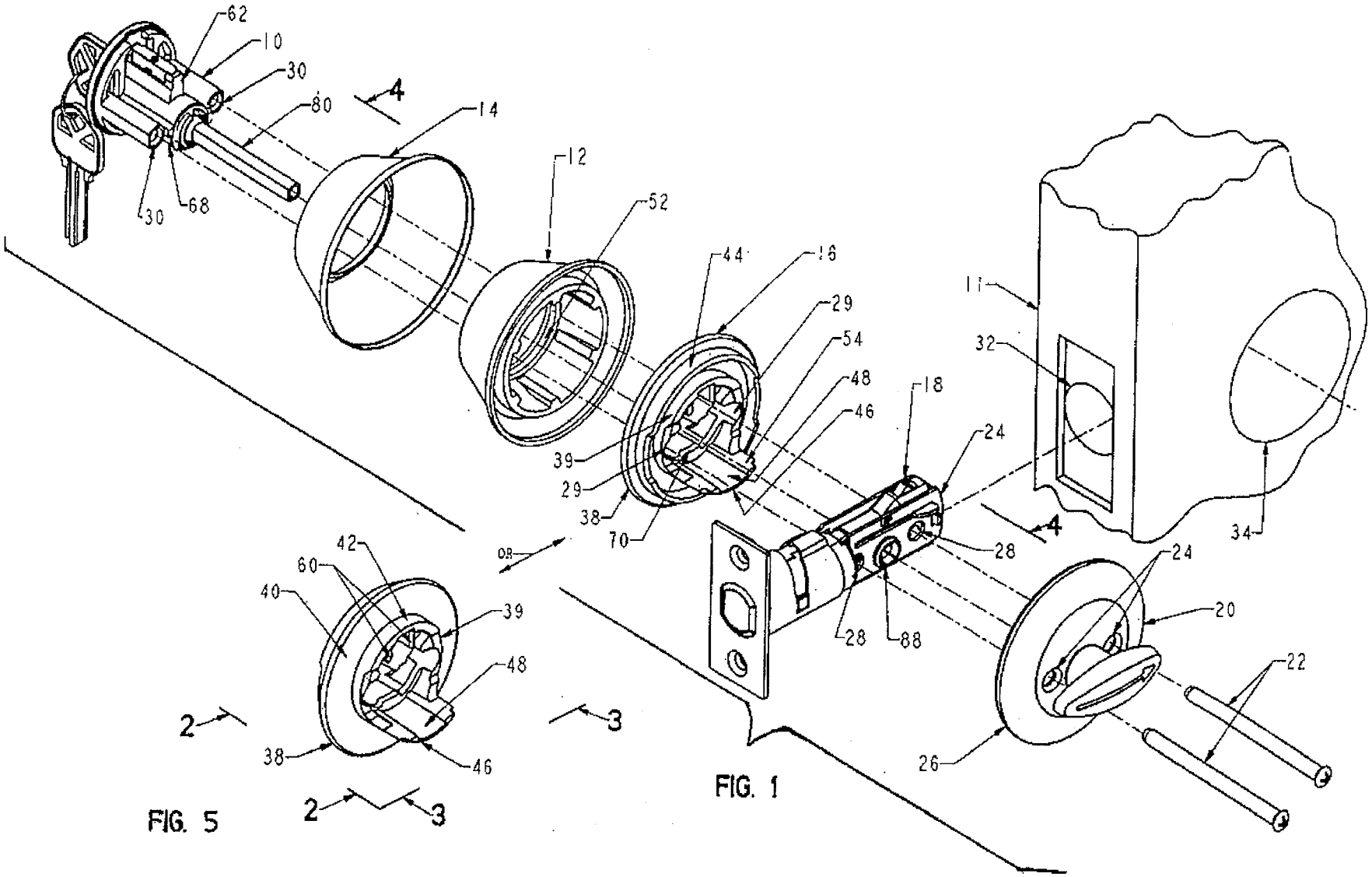
FIG. 1 is an oblique, separated view of an auxiliary lock made in accordance with the teachings of the present invention.
FIG. 5 is a view of the reversible adaptor shown in FIG. 1 reversed to show the other side.
Figure 3:
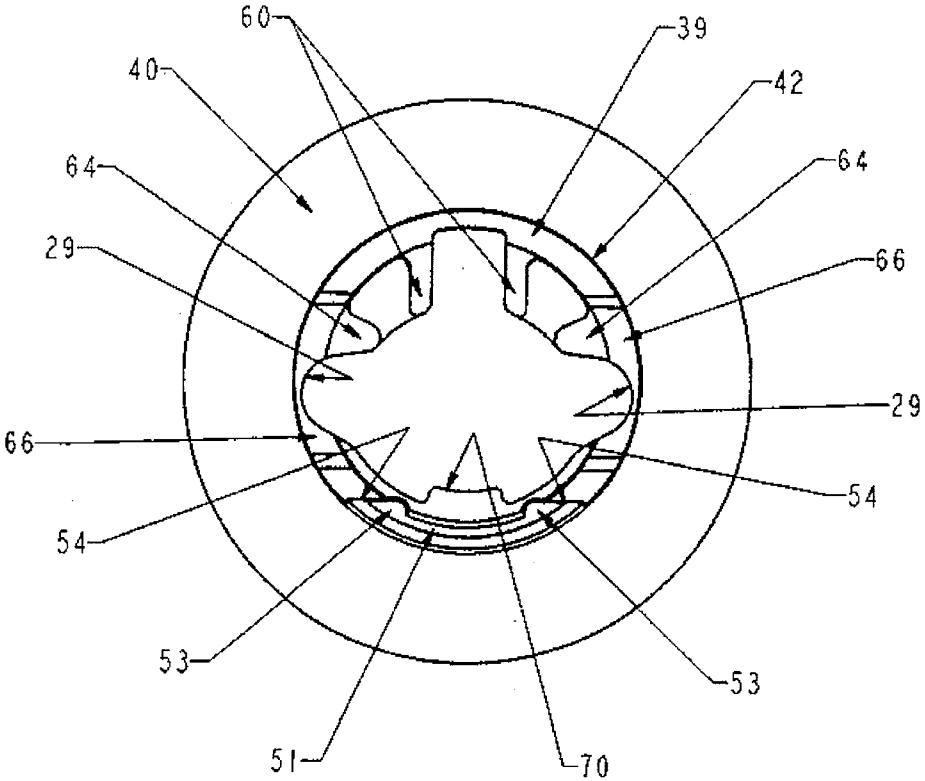
FIG. 3 is an axial view of the adapter looking at the side of the adapter to be inserted into a 1½" lock set hole.

FIG. 1 shows a single cylinder deadbolt (auxiliary) lock which has a cylinder housing 10 on the exterior of a door 11, an exterior free rotating cylinder guard 12, a cover 14, a reversible adapter 16, a latch assembly 18, and a turn piece and rose assembly 20. The deadbolt is held together by a pair of mounting screws 22 which extend through holes 24 in the rose 26 and holes 28 in the casing of the latch assembly. The screws then extend through grooves 29 in the adapter and screw into suitable threaded holes in the mounting posts 30 of the housing 10. The door has a horizontal latch hole 32 which is drilled into the edge of the door for receiving the casing 24 of the latch assembly, and a lock set hole 34 which is cut through the door.

In FIG. 1, the adapter 16 is shown in the line of separated components with the large diameter side of the adapter facing the door and is shown with the small diameter side of the adapter facing the door in the offset illustration. The adapter has a central plate 38 and a central hub 39 and the side of the adapter which will enter a small lock set hole (1½") has an annular flat surface 40 for engaging the door. Projecting outwardly from this face and a part of the central hub 39 is an annular lip 42 which can be inserted into a 1½" lock set hole. This same annular lip 42 also projects outwardly from the other side of the plate to define the exterior of the hub 39. Also projecting outwardly from the side of the plate, which is to cooperate with a door having a 2⅛" (large) lock set hole, is a second annular lip 44 having a diameter selected to enter a 2⅛" lock set hole.

The hub also includes a tongue structure 46 which is provided on each side of the plate for preventing rotation of the adapter whether the adapter is inserted into the large hole or into the small hole. The tongue includes an axial extension 48 of the small diameter annular lip which has a length selected so that the end of the tongue will be located underneath the latch assembly casing 24 (FIG. 4).

Figure 2:
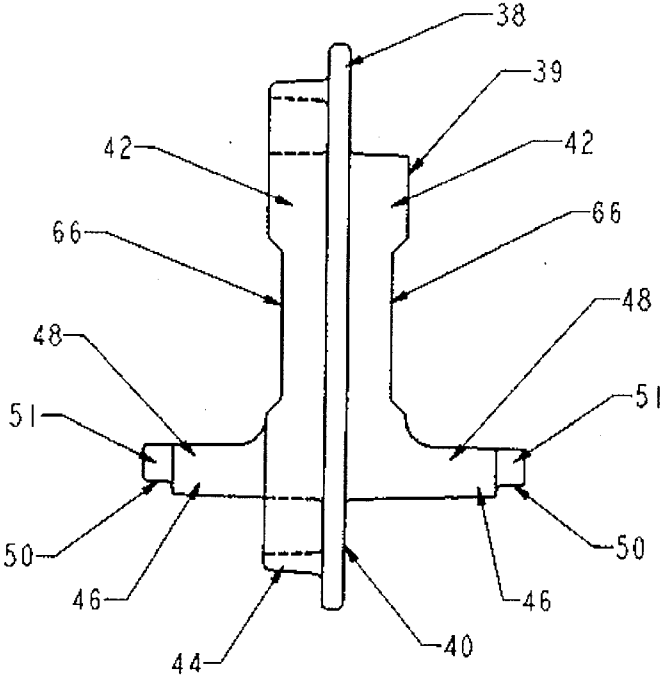
FIG. 2 is a view of the adapter taken at 2—2 of FIG. 5.

The end of each tongue is notched 50 (FIG. 2) defining a reduced thickness portion 51 to accommodate an annular rib 52 of the guard. The sides of the tongue 48 are reinforced with axially extending ribs 53 which define top flat horizontal surfaces 54 to lie beneath and proximate to the latch casing 24.

To prevent rotation of the adapter, a pair of downward struts 60 capture the chimney 62 of the cylinder housing. Additionally, the grooves 29 defined in the small diameter annular lip capture the mounting screw receiving posts 30 of the cylinder housing 10. These cutouts are reinforced by inwardly projecting ribs 64. This also prevents the rotation of the adapter. To provide a support for the barrel 68 of the cylinder housing, a pad 70 is provided. As can be seen from either side of the adapter, this annular lip and all the structure within the central hole will be identical whether the adapter is viewed from one side or the other. The second side of the adapter differs only in that a larger diameter annular lip 44 is provided for insertion into a 2⅛" lock set hole. Recesses 66 are defined in both the larger and smaller annular lips to accommodate the latch casing 24.

Figure 4:
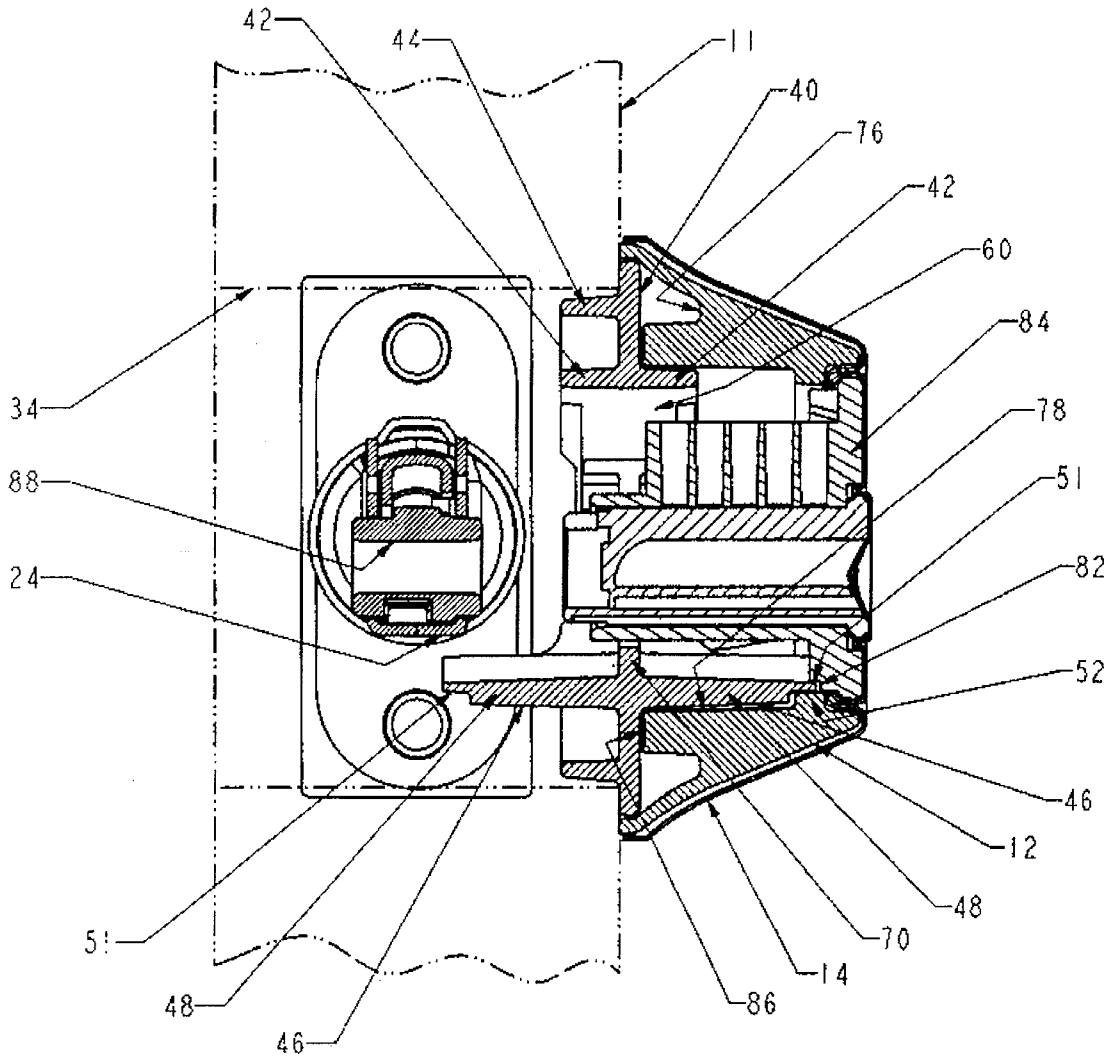
FIG. 4 is an elevational cross sectional view of the auxiliary lock shown in FIG. 5, mounted on a door having a 2⅛" lock set hole.

The hub portion remote from the door is suitably received by the cylinder guard (FIG. 4). The guard has an annular groove 76 for receiving the large diameter annular lip 44 and the central bore 78 of the cylinder guard is sized for receiving the small diameter annular lip 42 (and the tongue 46). As can be seen from FIG. 4, the end 51 of the tongue may be beveled or notched 50 to accommodate the shape of the cylinder guard and a notch 82 may be cut into the face 84 of the cylinder housing to accommodate the tongue. Both can be removed where the guard has sufficient length. The cylinder guard has a set back annular surface 86 against which the annular seating surface 40 may locate to position the central plate 38 fully within the opening of the cylinder guard.

Also shown in FIG. 4 is the hole 88 in the latch assembly which receives the torquing spindle 80 of the cylinder housing. The adapter accordingly extends the cylinder guard to an axial location which fully encloses the cylinder housing.

I claim:

1. An auxiliary lock for a door having a latch hole and a mutually perpendicular lock set hole which can have either a large or small diameter comprising a latch assembly having an elongated casing to be received by the latch hole, a cylinder lock assembly including a cylinder housing having a barrel portion and a pair of screw receiving posts for extending axially into the lock set hole and a chimney portion, a reversible adapter including a cylindrical plate having first and second sides and a central hub, a large diameter annular lip projecting axially from said first side for insertion into a large diameter lock set hole, said central hub including a first small diameter annular lip projecting axially from said first side and a second small diameter annular lip projecting axially from said second side for insertion into a small diameter lock set hole, means for receiving said cylinder housing and for preventing the rotation of said cylinder housing relative to said central hub, and a torque limiting tongue projecting axially from each of said small diameter annular lips proximate the bottom thereof, said torque limiting tongues having a length selected so that whether said adapter is inserted into a large or small diameter hole, the inserted torque limiting tongue will underlie said elongated casing.

2. An auxiliary lock according to claim 1, wherein said receiving and preventing means comprises a pair of grooves cut into said first and second small diameter annular lips for receiving said pair of screw receiving posts.

3. An auxiliary lock according to claim 2, wherein said receiving and preventing means comprises a pair of struts for capturing said chimney portion.

4. An auxiliary lock according to claim 3, wherein said receiving and preventing means further comprises an inwardly projecting rib adjacent each of said grooves for extending said grooves inwardly.

5. An auxiliary lock according to claim 4, further comprising pad means beneath and proximate to said barrel portion.

6. An auxiliary lock according to claim 2 wherein each of said tongues comprises a segment of a cylinder and the sides of said segment include flat, horizontal axially extending surfaces.

* * * * *